US008965227B2

(12) United States Patent
Mizutani et al.

(10) Patent No.: US 8,965,227 B2
(45) Date of Patent: Feb. 24, 2015

(54) IMAGE FORMING APPARATUS INCLUDING FORCED TONER CONSUMPTION CONTROL

(71) Applicants: Takehide Mizutani, Kanagawa (JP); Shinya Tanaka, Kanagawa (JP); Yasunobu Shimizu, Kanagawa (JP); Hirokazu Ishii, Tokyo (JP); Keigo Nakamura, Kanagawa (JP)

(72) Inventors: Takehide Mizutani, Kanagawa (JP); Shinya Tanaka, Kanagawa (JP); Yasunobu Shimizu, Kanagawa (JP); Hirokazu Ishii, Tokyo (JP); Keigo Nakamura, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/785,621

(22) Filed: Mar. 5, 2013

(65) Prior Publication Data

US 2013/0236201 A1 Sep. 12, 2013

(30) Foreign Application Priority Data

Mar. 12, 2012 (JP) ..... 2012-054559

(51) Int. Cl.
*G03G 15/16* (2006.01)
*G03G 15/00* (2006.01)

(52) U.S. Cl.
CPC ..... *G03G 15/1675* (2013.01); *G03G 15/1605* (2013.01); *G03G 15/556* (2013.01); *G03G 15/6591* (2013.01)
USPC ..... 399/53; 399/66

(58) Field of Classification Search
USPC ..... 399/53, 66
See application file for complete search history.

(56) References Cited

U.S. PATENT DOCUMENTS

| | | | |
|---|---|---|---|
| 5,515,146 | A | 5/1996 | Harasawa et al. |
| 5,631,725 | A | 5/1997 | Harasawa et al. |
| 5,812,919 | A | 9/1998 | Takano et al. |
| 5,822,667 | A | 10/1998 | Hayama et al. |
| 5,930,573 | A | 7/1999 | Miyamoto et al. |

(Continued)

FOREIGN PATENT DOCUMENTS

| | | |
|---|---|---|
| JP | 04-086878 | 3/1992 |
| JP | 09-146381 | 6/1997 |

(Continued)

OTHER PUBLICATIONS

U.S. Appl. No. 13/680,629, filed Nov. 19, 2012, Hiromi Ogiyama, et al.

(Continued)

*Primary Examiner* — Walter L Lindsay, Jr.
*Assistant Examiner* — Arlene Heredia Ocasio
(74) *Attorney, Agent, or Firm* — Oblon, Spivak, McClelland, Maier & Neustadt, L.L.P.

(57) ABSTRACT

An image forming apparatus includes a toner forced consumption control unit that performs toner forced consumption control in which toner in a developing unit is forcibly consumed when a certain condition to perform the toner forced consumption control is met. The certain condition to perform the toner forced consumption control includes a specific performance condition that a transfer bias switching condition to switch a transfer bias to a superimposed transfer bias in which an alternating current component is superimposed on a direct current component, from a direct current transfer bias is met. When the specific performance condition is met, the toner forced consumption control unit performs preliminary toner forced consumption control in which the toner forced consumption control is performed before an image forming operation using the superimposed transfer bias is started.

8 Claims, 8 Drawing Sheets

(56) References Cited

U.S. PATENT DOCUMENTS

| | | | | |
|---|---|---|---|---|
| 6,188,862 | B1 | 2/2001 | Ishii | |
| 6,282,386 | B1 | 8/2001 | Ishii | |
| 2003/0035658 | A1 | 2/2003 | Ishii | |
| 2003/0219289 | A1 | 11/2003 | Kawahara et al. | |
| 2003/0219296 | A1 | 11/2003 | Kabata et al. | |
| 2003/0235424 | A1 | 12/2003 | Kawahara et al. | |
| 2005/0078992 | A1 | 4/2005 | Kawahara et al. | |
| 2005/0180767 | A1 | 8/2005 | Ishii et al. | |
| 2006/0029405 | A1 | 2/2006 | Tanaka et al. | |
| 2006/0228125 | A1* | 10/2006 | Itagaki et al. | 399/55 |
| 2007/0127941 | A1 | 6/2007 | Ishii et al. | |
| 2008/0260401 | A1 | 10/2008 | Shimazaki | |
| 2009/0196638 | A1 | 8/2009 | Sukesako et al. | |
| 2010/0008687 | A1 | 1/2010 | Ishii | |
| 2010/0040386 | A1 | 2/2010 | Mizutani et al. | |
| 2011/0229168 | A1 | 9/2011 | Shiraishi et al. | |
| 2011/0229234 | A1* | 9/2011 | Hozumi et al. | 399/357 |
| 2012/0008991 | A1 | 1/2012 | Shimizu | |
| 2012/0045231 | A1 | 2/2012 | Ogino et al. | |
| 2012/0045237 | A1 | 2/2012 | Aoki et al. | |
| 2012/0045259 | A1 | 2/2012 | Nakamura et al. | |
| 2012/0099883 | A1* | 4/2012 | Kikuchi et al. | 399/71 |
| 2012/0170951 | A1 | 7/2012 | Ishii | |
| 2012/0224870 | A1* | 9/2012 | Kikuchi et al. | 399/44 |
| 2012/0230715 | A1 | 9/2012 | Ogino et al. | |
| 2012/0237234 | A1* | 9/2012 | Sugimoto et al. | 399/50 |
| 2012/0237271 | A1* | 9/2012 | Sengoku et al. | 399/296 |
| 2012/0243892 | A1 | 9/2012 | Nakamura et al. | |
| 2012/0308250 | A1 | 12/2012 | Shimizu et al. | |
| 2012/0315058 | A1 | 12/2012 | Shimizu et al. | |
| 2012/0328314 | A1 | 12/2012 | Sugimoto et al. | |
| 2012/0328315 | A1 | 12/2012 | Takeuchi et al. | |
| 2012/0328320 | A1 | 12/2012 | Fujita et al. | |
| 2012/0328321 | A1 | 12/2012 | Takeuchi et al. | |
| 2013/0004190 | A1 | 1/2013 | Sengoku et al. | |
| 2013/0011155 | A1 | 1/2013 | Ogiyama et al. | |
| 2013/0016989 | A1 | 1/2013 | Fujita et al. | |

FOREIGN PATENT DOCUMENTS

| | | |
|---|---|---|
| JP | 2006-047651 | 2/2006 |
| JP | 2006-267486 | 10/2006 |
| JP | 2007-108623 | 4/2007 |
| JP | 2008-058585 | 3/2008 |
| JP | 2008-216601 | 9/2008 |

OTHER PUBLICATIONS

U.S. Appl. No. 13/666,474, filed Nov. 1, 2012, Yasunobu Shimizu, et al.
U.S. Appl. No. 13/602,840, filed Sep. 4, 2012, Keigo Nakamura, et al.
U.S. Appl. No. 13/646,898, filed Oct. 8, 2012, Ryuuichi Mimbu, et al.
U.S. Appl. No. 13/633,341, filed Oct. 2, 2012, Yasunobu Shimizu, et al.
U.S. Appl. No. 13/651,776, filed Oct. 15, 2012, Shinya Tanaka, et al.

* cited by examiner

| SECONDARY TRANSFER MODE | DIRECT CURRENT TRANSFER MODE | SUPERIMPOSED TRANSFER MODE | | | |
|---|---|---|---|---|---|
| PERFORM REFRESH MODE | A N/A | B N/A | C (EMBODIMENT) BEFORE PRINTING ONLY | D (EMBODIMENT) BEFORE PRINTING + INTERVAL BETWEEN SHEETS | E (MODIFICATION) BEFORE PRINTING + INTERVAL BETWEEN SHEETS |
| BEGINNING | 2 | 3 | 4 | 4 | 4.5 |
| AFTER 2K SHEETS PASSED THROUGH | 2 | 3 | 3.5 | 4 | 4.5 |
| AFTER 5K SHEETS PASSED THROUGH | 2 | 3 | 3 | 4 | 4.5 |

IMAGE FORMING APPARATUS INCLUDING FORCED TONER CONSUMPTION CONTROL

CROSS-REFERENCE TO RELATED APPLICATIONS

The present application claims priority to and incorporates by reference the entire contents of Japanese Patent Application No. 2012-054559 filed in Japan on Mar. 12, 2012.

BACKGROUND OF THE INVENTION

1. Field of the Invention

The present invention generally relates to an image forming apparatus such as a copier, a printer, and a facsimile machine. More particularly, the invention relates to an image forming apparatus that transfers a toner image on an intermediate transfer member or a latent image carrier to a recording medium using a transfer bias applied by a transfer unit.

2. Description of the Related Art

In an image forming apparatus with an electrophotographic system, electrostatic latent images obtained by forming optical image information on a latent image carrier such as a photosensitive element uniformly charged in advance are visualized by toner from a developing unit. The visible images are transferred on a recording medium such as a transfer paper sheet directly or via an intermediate transfer member such as an intermediate transfer belt and fixed onto the recording medium, whereby image forming is performed. In most of such image forming apparatuses a direct current transfer bias is applied using a transfer unit at the time of transfer from an image carrier such as the photosensitive element or the intermediate transfer member to the recording medium.

Recently, as a recording medium for the image forming apparatus, various types of sheet of paper such as a sheet with an expensive-looking leather-like pattern or a Japanese-paper-style sheet have become increasingly in use. Some of such recording media have some roughness due to emboss processing, for example, on the surface thereof with the purpose of creating an expensive look. When toner images are transferred on such a recording medium, the toner hardly adheres to the recesses on the surface of the recording medium compared with the protrusions thereon. Accordingly, when toner images are transferred on a recording medium with relatively large surface unevenness, the toner cannot be sufficiently transferred onto the recesses, whereby the image density on the recesses is likely to be relatively low compared with that on the protrusions. As a result, an uneven density pattern following the pattern of unevenness on the surface of the recording medium readily occurs in the images.

As a method to improve the defective transfer to the recesses on the surface of the recording medium described above, a method to use a transfer bias in which an alternating current component is superimposed on a direct current component, and the polarity thereof changes with time (hereinafter, referred to as the superimposed transfer bias) has been known and proposed in Japanese Patent Application Laid-open No. 2006-267486, Japanese Patent Application Laid-open No. 2008-058585, Japanese Patent Application Laid-open No. 9-146381, and Japanese Patent Application Laid-open No. 4-086878, for example. By switching the transfer mode between the direct current transfer mode and a transfer mode in which the alternating current component is superimposed on the direct current component (hereinafter, referred to as the superimposed transfer mode) depending on the type of recording medium to be fed into the image forming apparatus, appropriate transferability can be obtained for various types of recording media including such a recording medium with relatively large surface unevenness.

It is known that transferability to recording media depends on a deterioration state of toner. For example, when an image having a low image area ratio is consecutively output, a small amount of toner is supplied to and discharged from the developing unit, thus a large amount of toner that has been stirred for a long time remains in the developing unit. The toner that has been damaged due to such stirring for a long time, of which outer additives are buried in or isolated from the toner, deteriorates flowability of developer or changes charge properties of the toner. As a result, transferability is deteriorated, whereby sufficient transferability can be hardly obtained.

As a method to improve the low transferability due to the deterioration of toner as described above, a method to replace the toner in the developing unit with new toner replenished while forcibly consuming the deteriorated toner in the developing unit has been known and proposed in Japanese Patent Application Laid-open No. 2008-216601, Japanese Patent Application Laid-open No. 2006-47651, and Japanese Patent Application Laid-open No. 2007-108623, for example.

As a result of study, the inventors of the present invention have found that the effect of the deterioration of toner on the transferability depends on the existence of unevenness on the surface of the recording medium. In other words, the effect of the deterioration of toner on the transferability varies depending on whether the direct current transfer bias or the superimposed transfer bias is used. Specifically, when toner is transferred to a recording medium with roughness using a superimposed transfer bias in a superimposed transfer mode or the like, the effect of the deterioration of toner on the transferability is significant, whereby transferability when the deteriorated toner is used is remarkably deteriorated. Accordingly, the deterioration state of toner with which the transferability is permissible in the direct current transfer mode may cause remarkable deterioration of transferability exceeding tolerance in the superimposed transfer mode. This is probably because deteriorated toner cannot follow the change of the bias with time in the superimposed transfer mode, whereby the toner within the transferred field cannot exhibit an intended behavior.

In view of the above, there is a need to provide an image forming apparatus capable of improving transferability when a superimposed transfer bias is used even if deterioration of toner in a developing unit of the image forming apparatus has progressed.

SUMMARY OF THE INVENTION

It is an object of the present invention to at least partially solve the problems in the conventional technology.

An image forming apparatus includes: a latent image carrier that carries on a surface thereof a latent image depending on image information; a developing unit that performs development processing in which toner is caused to adhere to the latent image on the latent image carrier by a developer so as to form a toner image; a transfer unit that transfers the toner image formed on the latent image carrier through the development processing, onto a recording medium directly or via an intermediate transfer member; a transfer bias switching unit that switches a transfer bias applied to the transfer unit when the toner image is transferred on a recording medium, between a direct current transfer bias consisting of a direct current component and a superimposed transfer bias in which an alternating current component is superimposed on a direct current component and polarity of the superimposed transfer bias changes with time, according to a certain transfer bias switching condition; and a toner forced consumption control unit that performs toner forced consumption control in which toner in the developing unit is forcibly consumed when a certain condition to perform the toner forced consumption control is met. The certain condition to perform the toner forced consumption control includes a specific performance condition that a transfer bias switching condition to switch the transfer bias to the superimposed transfer bias is met. When the specific performance condition is met, the toner forced consumption control unit performs preliminary toner forced consumption control in which the toner forced consumption control is performed before an image forming operation using the superimposed transfer bias is started.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An electrophotographic color printer (hereinafter simply referred to as the printer) will now be described as an image forming apparatus according to the embodiment of the present invention.

Figure 1:
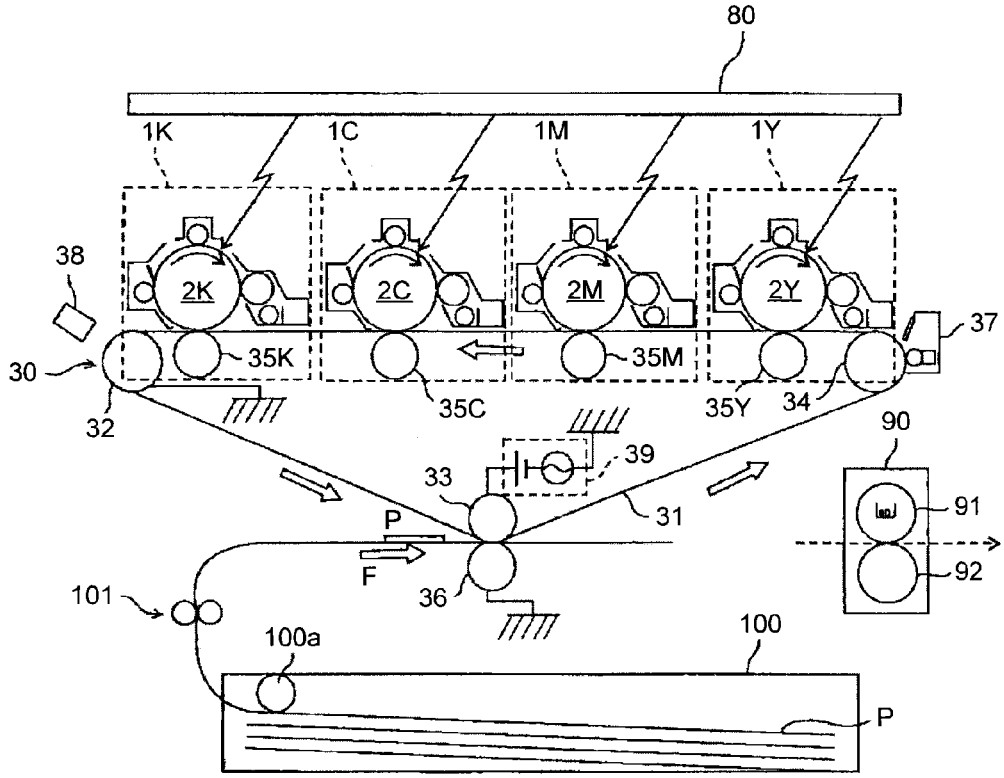
FIG. 1 is a schematic structural diagram of a printer according to an embodiment of the present invention.

A basic structure of the printer according to the embodiment will be first described. FIG. 1 is a schematic structural diagram illustrating the printer according to the embodiment. The printer according to the embodiment includes four image forming units 1Y, 1M, 1C, and 1K for forming toner images of yellow, magenta, cyan, and black (hereinafter referred to as Y, M, C, and K, respectively) colors, a transfer unit 30 serving as a transfer device, an optical writing device 80, a fixing unit 90, a paper cassette 100, and a pair of registration rollers 101.

Figure 2:
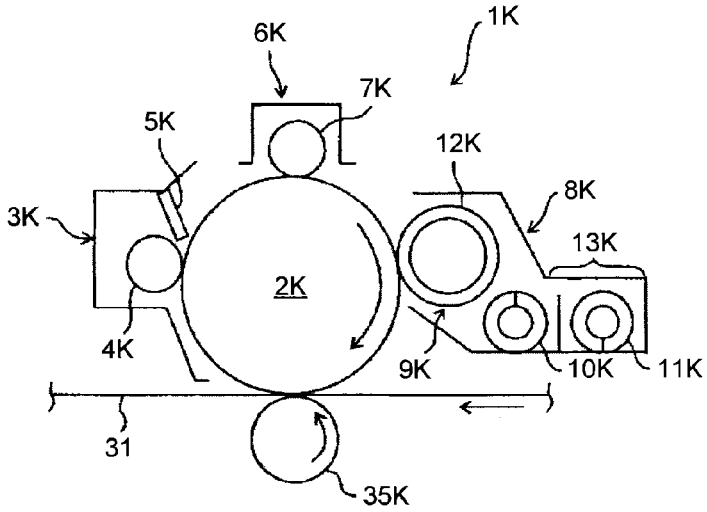
FIG. 2 is an enlarged structural diagram of an enlarged view of an image forming unit for a black color in the printer according to the embodiment.

The four image forming units 1Y, 1M, 1C, and 1K use, as image forming material, Y, M, C, and K toners, respectively, which are different in color from one another. Except for the difference in color, the image forming units 1Y, 1M, 1C, and 1K are similar in structure, and are replaced by new image forming units when the lifetime thereof expires. For example, as illustrated in FIG. 2, the image forming unit 1K for forming a K toner image includes a drum-shaped photosensitive element 2K serving as a latent image carrier, a drum cleaning device 3K, a neutralization device (not illustrated), a charging device 6K, a developing unit 8K, and so forth. The above-described components are held in a common holder that is detachably attached to a body of the printer as a unit. It is thereby possible to replace the components at the same time.

The photosensitive element 2K is constructed of a drum-shaped base having an outer circumferential surface provided with an organic photosensitive layer and a diameter of approximately 60 mm in a drum shape, and is driven to rotate clockwise in the drawing by a driving unit (not illustrated). In the charging device 6K, a charging roller 7K applied with a charging bias is brought into contact with or in proximity to the photosensitive element 2K to cause discharge between the charging roller 7K and the photosensitive element 2K. Thereby, an outer circumferential surface of the photosensitive element 2K is uniformly charged. In the printer of the embodiment, the surface of the photosensitive element 2K is uniformly charged to the same negative polarity as a normal charge polarity of toner. As the charging bias, an alternating current (AC) power supply superimposed on a direct current (DC) power supply is employed. The charging roller 7K is constructed of a metal core having an outer circumferential surface covered with a conductive elastic layer made of a conductive elastic material. The method of bringing a charging member, such as the charging roller, into contact with or in proximity to the photosensitive element 2K may be replaced by a method using an electric charger.

The uniformly charged surface of the photosensitive element 2K is subjected to optical scanning with a laser light emitted from the optical writing device 80, and carries an electrostatic latent image for the K color. The electrostatic latent image for the K color is developed into a K toner image by the developing unit 8K (not illustrated) using K toner. Then, the K toner image is primarily transferred onto a later-described intermediate transfer belt 31 serving as an intermediate transfer member.

The drum cleaning device 3K removes post-transfer residual toner adhering to the surface of the photosensitive element 2K after a primary transfer process, i.e., after the passage through a later-described primary transfer nip. The drum cleaning device 3K includes a cleaning brush roller 4K driven to rotate, and a cantilever-supported cleaning blade 5K having a free end brought into contact with the photosensitive element 2K. The rotating cleaning brush roller 4K scrapes the post-transfer residual toner from the surface of the photosensitive element 2K. The cleaning blade scrapes the post-transfer residual toner off the surface of the photosensitive element 2K. The cleaning blade is brought into contact with the photosensitive element 2K in a counter direction in which the cantilever-supported end of the cleaning blade is directed further downstream in the photosensitive element rotation direction than the free end of the cleaning blade.

The above-described neutralization device neutralizes residual charge remaining on the photosensitive element 2K after the cleaning by the drum cleaning device 3K. With the neutralizing, the surface of the photosensitive element 2K is initialized to prepare for the next image forming operation.

The developing unit 8K includes a development section 12K housing a developing roller 9K as a developer carrier, and a developer conveying section 13K for stirring and conveying a K developer (not illustrated). The developer conveying section 13K includes a first conveying chamber housing a first screw member 10K, and a second conveying chamber housing a second screw member 11K. Each of the first screw member 10K and the second screw member 11K includes a rotary shaft member having both end portions in an axial direction thereof rotatably supported by respective shaft bearings, and a helical blade helically protruding from an outer circumferential surface of the rotary shaft.

The first conveying chamber housing the first screw member 10K and the second conveying chamber housing the second screw member 11K are separated by a partition wall. The partition wall has both end portions in the axial direction of the first screw member 10K and the second screw member 11K formed with communication ports through which the two conveying chambers communicate with each other. The first screw member 10K is driven to rotate and stir, in a rotation direction thereof, the K developer (not illustrated) held inside the helical blade in accordance with the rotation of the first screw member 10K, and conveys the K developer from the far side toward the near side in a direction perpendicular to the plane of the drawing. The first screw member 10K and the later-described developing roller 9K are arranged in parallel to each other while facing each other. In this case, therefore, a conveyance direction of the K developer extends along an axial direction of the developing roller 9K. The first screw member 10K supplies the K developer to an outer circumferential surface of the developing roller 9K along the axial direction of the developing roller 9K.

The K developer conveyed to the proximity of an end portion of the first screw member 10K on the near side in the drawing enters the second conveying chamber through the communication port provided near the end portion of the partition wall on the near side in the drawing. Thereafter, the K developer is held inside the helical blade of the second screw member 11K. Then, as the second screw member 11K is driven to rotate, the K developer is stirred in a rotation direction of the second screw member 11K and conveyed from the near side toward the far side in the drawing.

In the second conveying chamber, a K toner density detection sensor is mounted on a lower wall of a casing of the developing unit 8K to detect the K toner density in the K developer in the second conveying chamber. A magnetic permeability sensor is employed as the K toner density detection sensor. The magnetic permeability of the K developer containing the K toner and magnetic carriers is correlated with the K toner density. Therefore, the magnetic permeability sensor detects the K toner density.

The printer of the embodiment includes Y, M, C, and K toner replenishment units (not illustrated) for separately replenishing the Y, M, C, and K toners into the respective second conveying chambers of the developing units for the Y, M, C, and K colors. The controller of the printer stores, in a random access memory (RAM), a value Vtref for each of the Y, M, C, and K colors, which is the target value of the voltage output from each of the Y, M, C, and K toner density detection sensors. If the difference between the value of the voltage output from one of the Y, M, C, and K toner density detection sensors and the target value Vtref corresponding to one of the Y, M, C, and K colors exceeds a predetermined value, the corresponding one of the Y, M, C, and K toner replenishment units is driven for a length of time corresponding to that difference. Thereby, the second conveying chamber of the corresponding one of the developing units for the Y, M, C, and K colors is replenished with the corresponding one of the Y, M, C, and K toners.

The developing roller 9K housed in the development section 12K is disposed opposite the first screw member 10K, and is also disposed opposite the photosensitive element 2K through an opening disposed in the casing. The developing roller 9K includes a cylindrical development sleeve constructed of a non-magnetic pipe and driven to rotate, and a magnet roller fixed inside the development sleeve so as not to be rotated together with the development sleeve. With magnetic force generated by the magnet roller, the developing roller 9K carries, on an outer circumferential surface of the development sleeve, the K developer supplied by the first screw member 10K, and conveys the K developer to a development area disposed opposite the photosensitive element 2K in accordance with the rotation of the development sleeve.

The development sleeve is applied with a development bias, which is the same in polarity as the K toner and has an electric potential higher than the electric potential of the electrostatic latent image on the photosensitive element 2K and lower than the electric potential of the uniformly charged surface of the photosensitive element 2K. Between the development sleeve and the electrostatic latent image on the photosensitive element 2K, therefore, a development potential arises, which electrostatically moves the K toner on the development sleeve toward the electrostatic latent image. Meanwhile, between the development sleeve and the background area on the photosensitive element 2K, a non-development potential arises, which moves the K toner on the development sleeve toward the surface of the development sleeve. With the action of the development potential and the non-development potential, the K toner on the development sleeve is selectively transferred to the electrostatic latent image on the photosensitive element 2K to develop the electrostatic latent image into the K toner image.

Similar to the image forming unit 1K for the K color, toner images of Y, M, and C are formed on the photosensitive elements 2Y, 2M, and 2C of the image forming units 1Y, 1M, and 1C for the Y, M, and C colors, respectively as illustrated in FIG. 1.

Above the image forming units 1Y, 1M, 1C, and 1K, the optical writing unit 80 serving as a latent image forming unit is arranged. The optical writing unit 80 optically scans the photosensitive elements 2Y, 2M, 2C, and 2K with a light beam projected from a laser diode based on image information received from an external device such as a personal computer (PC). Accordingly, the electrostatic latent images of Y, M, C, and K are formed on the photosensitive elements 2Y, 2M, 2C, and 2K, respectively. Specifically, the electrostatic latent image has electric potential on the portion irradiated with the laser light out of the uniformly charged entire surface of the photosensitive element 2Y less than the electric potential of the other area, that is, the background portion. The optical writing unit 80 irradiates the photosensitive element with the laser light L emitted from a light source and deflected in a main scanning direction by the polygon mirror rotated by a polygon motor (not illustrated) through a plurality of optical lenses or mirrors. The optical writing unit 80 may employ a light source using an LED array including a plurality of LEDs that project light.

Below the image forming units 1Y, 1M, 1C, and 1K, the transfer unit 30 is disposed as a transfer device that stretches and endlessly moves the endless intermediate transfer belt 31 in a counterclockwise direction in the drawing while stretching the endless intermediate transfer belt 31. The transfer unit 30 includes, in addition to the intermediate transfer belt 31, a driving roller 32, a secondary transfer back side roller 33, a cleaning backup roller 34, four primary transfer rollers 35Y, 35M, 35C, 35K, a nip formation roller 36, a belt cleaning device 37, and a toner image detection sensor 38.

The intermediate transfer belt 31 is stretched over the driving roller 32, the secondary transfer back side roller 33, the cleaning backup roller 34, and the four primary transfer rollers 35Y, 35M, 35C, and 35K disposed inside the loop. The driving roller 32 is rotated by a driving unit (not illustrated) in the counterclockwise direction in the drawing, enabling the intermediate transfer belt 31 to rotate in the same direction.

The intermediate transfer belt 31 in the embodiment has the following characteristics: a thickness of 20 to 200 μm, preferably approximately 60 μm; a volume resistivity of $1\times10^{7.5}$ to $1\times10^{13}$ Ω·cm, preferably approximately $1\times10^{9}$ Ω·cm. The value of the volume resistivity was obtained through measurement using a Mitsubishi Chemical Hiresta-HRS probe with an applied voltage of 100 V and a measurement time of 10 seconds. The intermediate transfer belt 31 has a surface resistivity of $1\times10^{10}$ to $1\times10^{12}$ Ω/sq. The value of the surface resistivity was obtained through measurement using a Mitsubishi Chemical Hiresta-HRS probe with an applied voltage of 500 V and a measurement time of 10 seconds. The intermediate transfer belt 31 of the embodiment may be made of a carbon dispersed polyimide resin, for example.

The intermediate transfer belt 31 is endlessly moved nipped between the four primary transfer rollers 35Y, 35M, 35C, and 35K and the photosensitive elements 2Y, 2M, 2C, and 2K. Thereby, primary transfer nips for the Y, M, C, and K colors are formed in which an outer circumferential surface of the intermediate transfer belt 31 comes into contact with the photosensitive elements 2Y, 2M, 2C, and 2K. The primary transfer rollers 35Y, 35M, 35C, and 35K are applied with a primary transfer bias by primary transfer bias power supplies (not illustrated), respectively. Thereby, transfer electric fields are generated between the Y, M, C, and K toner images on the photosensitive elements 2Y, 2M, 2C, and 2K and the primary transfer rollers 35Y, 35M, 35C, and 35K. In accordance with the rotation of the photosensitive element 2Y for the Y color, the Y toner image formed on the surface of the photosensitive element 2Y enters the primary transfer nip for the Y color. Then, with the action of the transfer electric field and nip pressure, the Y toner image is primarily transferred from the photosensitive element 2Y onto the intermediate transfer belt 31. Thereafter, the intermediate transfer belt 31 having the Y toner image thus primarily transferred thereto sequentially passes the respective primary transfer nips for the M, C, and K colors. Then, the M, C, and K toner images on the photosensitive elements 2M, 2C, and 2K are sequentially primarily transferred onto the Y toner image in a superimposed manner. With this primary transfer of the toner images in the superimposed manner, a four-color superimposed toner image is formed on the intermediate transfer belt 31.

Each of the primary transfer rollers 35Y, 35M, 35C, and 35K includes an elastic roller constructed of a metal core with a conductive sponge layer fixed on an outer circumferential surface thereof. Each of the primary transfer rollers 35Y, 35M, 35C, and 35K has the following characteristics. An outer diameter of 16 mm and a core diameter of 10 mm. The resistance R of the sponge layer calculated from the current I that flows when a voltage of approximately 1000 V is applied to the core of the primary transfer roller in the state in which a grounded metal roller having an outer diameter of 30 mm is pressed to the sponge layer with a force of 10 N based on Ohm's law (R=V/I), is approximately $3\times10^{7}$Ω. The thus-structured primary transfer rollers 35Y, 35M, 35C, and 35K are applied with the primary transfer bias under constant current control. The primary transfer rollers 35Y, 35M, 35C, and 35K may be replaced by transfer chargers or transfer brushes.

The nip formation roller 36 of the transfer unit 30 is disposed outside the loop of the intermediate transfer belt 31. The intermediate transfer belt 31 is nipped between the nip formation roller 36 and the secondary transfer back side roller 33 disposed inside the loop of the intermediate transfer belt 31. Thereby, a secondary transfer nip is formed, in which the outer circumferential surface of the intermediate transfer belt 31 and the nip formation roller 36 come into contact with each other. The nip formation roller 36 is grounded, and the secondary transfer back side roller 33 is applied with a secondary transfer bias by a secondary transfer bias power supply 200. Between the secondary transfer back side roller 33 and the nip formation roller 36, therefore, a secondary transfer electric field is formed that electrostatically moves toner of negative polarity from the secondary transfer back side roller 33 toward the nip formation roller 36.

Below the transfer unit 30, the paper cassette 100 is provided that stores therein a sheet bundle including a plurality of stacked recording sheets P as recording media. In the paper cassette 100, the uppermost recording sheet P of the sheet bundle is caused to come into contact with a paper feeding roller 100*a*. The paper feeding roller 100*a* is driven to rotate at a predetermined time to send the recording sheet P into a paper feeding path. The pair of registration rollers 101 is provided near a lower end of the sheet feeding path. The pair of registration rollers 101 nips, between the both rollers, the recording sheet P that is fed from the paper cassette 100. Immediately thereafter, the rotation of the rollers is stopped. Then, the rollers are again driven to rotate at a timing to cause the nipped recording sheet P to synchronize with the four-color superimposed toner image on the intermediate transfer belt 31 in the secondary transfer nip, sending the recording sheet P toward the secondary transfer nip. The toner images included in the four-color superimposed toner image on the intermediate transfer belt 31 brought into close contact with the recording sheet P in the secondary transfer nip are secondarily transferred onto the recording sheet P at the same time by the action of the secondary transfer electric field and nip pressure, and are formed into a full-color toner image with white color of the recording sheet P. The recording sheet P having the full-color toner image thus formed on a surface thereof passes the secondary transfer nip, and separates from the nip formation roller 36 and the intermediate transfer belt 31 owing to the curvatures of the nip formation roller 36 and the intermediate transfer belt 31.

The secondary transfer back side roller 33 is formed by laminating a resistance layer on a core made of stainless or aluminum, for example. The resistance layer is formed by dispersing conductive particles of carbon or a metal complex in polycarbonate, a fluorine-based rubber or a silicon-based rubber, or made of a rubber of NBR or EPDM, a rubber of NBR/ECO copolymer, or a semiconductive rubber of polyurethane. The volume resistivity of the resistance layer is $10^6$ to $10^{12}$ Ω·cm, preferably $10^7$ to $10^9$ Ω·cm. A foamed-type resistance layer with hardness of 20 to 50 degrees or a rubber-type resistance layer with a rubber hardness of 30 to 60 degrees may be used. However, the resistance layer comes in contact with the nip formation roller 36 with the intermediate transfer belt 31 interposed therebetween, thus a sponge type is preferred, with which non-contacting area is generated even with a small contact pressure. The larger the contact pressure between the intermediate transfer belt 31 and the secondary transfer back side roller 33 is, the more likely a missing of a letter or a thin line is to occur. Therefore, a sponge type that requires a small contact pressure is preferred to prevent such a problem.

The value of the volume resistivity of the secondary transfer back side roller 33 is obtained as follows: An electrode roller is brought in contact with the circumferential surface of the secondary transfer back side roller 33 with a force of 5 N. While applying a voltage of 1000 V to the core of the secondary transfer back side roller 33, the secondary transfer back side roller 33 is rotated for a minute to measure the volume resistivity of every rotation of the secondary transfer back side roller 33 sequentially. The averaged value of the thus measured volume resistivity values is adopted.

The nip formation roller 36 is formed by laminating a resistance layer and a surface layer on a core made of stainless or aluminum, for example. In this example, the nip formation roller 36 has an outer diameter of 20 mm and the core made of stainless with a diameter of 16 mm. The resistance layer is a [JIS-A] made of rubber made of NBR/ECO copolymer with hardness of 40 to 60 degrees. The surface layer is made of fluorine-containing urethane elastomer and preferably has a thickness of 8 to 24 μm. That is because the surface layer of the roller is often manufactured in a coating process. When a thickness of the surface layer is not greater than 8 μm, an influence of irregularities in resistance due to unevenness of coating is large, and a leak may occur at a position where the resistance is low. Therefore, a thickness that is not greater than 8 μm is not preferable. A problem of a surface of the roller getting wrinkled and the surface layer cracked is also likely to occur. On the other hand, when the thickness of the surface layer is more than 24 μm, the resistance increases. If the volume resistance is high, a voltage when a constant current is applied to the core of the secondary transfer back side roller 33 may rise and exceeds a voltage variable range of the constant current power supply, and hence a current that is not greater than a target current may be provided. Alternatively, when the voltage variable range is sufficiently high, a leak readily occurs due to a high-voltage path from the constant current power supply to the core of the secondary transfer back side roller or a high voltage provided in the core of the secondary transfer back side roller. Another problem is that the hardness is increased and contact with respect to the recording medium (e.g., a paper sheet) or the intermediate transfer belt is deteriorated when a thickness of the surface layer of the nip formation roller 36 becomes 24 μm or above. The nip formation roller 36 has a surface resistivity of $1\times10^{6.5}$ Ω/sq. or above, and the surface layer of the nip formation roller 36 has a volume resistivity of $1\times10^{10}$ Ω·cm or above, and more preferably, $1\times10^{12}$ Ω·cm. In the embodiment, the nip formation roller on which the surface layer is laminated is used, however, the nip formation roller in which only the resistance layer is laminated on the core thereof may be used.

The toner image detection sensor 38 is disposed outside the loop of the intermediate transfer belt 31. In the entire area of the intermediate transfer belt 31 in a circumferential direction thereof, the toner image detection sensor 38 is opposed to a position where the intermediate transfer belt 31 is bridged over the grounded driving roller 32 with a gap of approximately 5 mm interposed therebetween. The toner image detection sensor 38 is an optical sensor of one-emission and two-reception type and performs adhesion amount detection of toner images that has been primarily transferred onto the intermediate transfer belt 31 by converting the output value that has been received to an adhesion amount of toner.

The fixing unit 90 is provided on the right side of the secondary transfer nip in the drawing. In the fixing unit 90, a fixing nip is formed by a fixing roller 91 including a heat generation source, such as a halogen lamp, and a pressure roller 92 that rotates while in contact with the fixing roller 91 with a predetermined pressure. The recording sheet P fed into the fixing unit 90 is nipped in the fixing nip such that a surface of the recording sheet P carrying an unfixed toner image is brought into close contact with the fixing roller 91. Then, with heat and pressure applied to the recording sheet P, the toner in the toner image is softened, and the full-color image is fixed on the recording sheet P. The recording sheet P discharged from the fixing unit 90 passes a post-fixation conveying path, and is discharged outside the printer.

To form a monochrome image, a support plate (not illustrated) supporting the primary transfer rollers 35Y, 35M, and 35C for the Y, M, and C colors in the transfer unit 30 is moved to separate the primary transfer rollers 35Y, 35M, and 35C away from the photosensitive elements 2Y, 2M, and 2C, respectively. The outer circumferential surface of the intermediate transfer belt 31 is separated from the photosensitive elements 2Y, 2M, and 2C, and the intermediate transfer belt 31 is brought into contact only with the photosensitive element 2K for the K color. In this state, only the image forming unit 1K for the K color is driven among the four image forming units 1Y, 1M, 1C, and 1K. The K toner image is thus formed on the photosensitive element 2K.

The secondary transfer bias power supply 39 includes a DC power supply and an AC power supply, and is capable of outputting a DC voltage superimposed on an AC voltage as the secondary transfer bias. The output terminal of the secondary transfer bias power supply 39 is coupled to the core of the secondary transfer back side roller 33. The electric potential value of the core of the secondary transfer back side roller 33 is nearly the same as the value of the output voltage from the secondary transfer bias power supply 39. The core of the nip formation roller 36 is grounded (earth connection). The structure of applying the superimposed transfer bias to the core of the secondary transfer back side roller 33 and grounding the core of the nip formation roller 36 may be replaced by a structure of applying the superimposed transfer bias to the core of the nip formation roller 36 and grounding the secondary transfer back side roller 33. In this case, the polarity of the DC voltage is changed. Specifically, if the superimposed transfer bias is applied to the secondary transfer back side roller 33 while using toner of negative polarity and grounding the nip formation roller 36, as illustrated in the drawing, a DC voltage of the same negative polarity as the polarity of the toner is used to set the time-averaged electric potential of the superimposed transfer bias to the same negative polarity as the polarity of the toner. If the secondary transfer back side roller 33 is grounded and the nip formation roller 36 is applied with the superimposed transfer bias, a DC voltage of positive polarity opposite the polarity of the toner is used to set the time-averaged electric potential of the superimposed transfer bias to positive polarity opposite the polarity of the toner. The structure of applying the superimposed transfer bias to the secondary transfer back side roller 33 or the nip formation roller 36 may be replaced by the structure of applying a DC voltage to one of the secondary transfer back side roller 33 and the nip formation roller 36 and applying an AC voltage to the other roller.

The AC voltage employed in the embodiment has a sinusoidal waveform. Alternatively, the AC voltage may have a rectangular waveform. Furthermore, if the recording sheet P is not a sheet with relatively large surface unevenness, such as a rough paper sheet, but a sheet with relatively small surface unevenness, such as a plain paper sheet, an uneven density pattern following the pattern of irregularities is not formed. In this case, therefore, a bias consisting of a DC voltage may be applied as the transfer bias. If a sheet with relatively large surface unevenness, such as a rough paper sheet, is used, however, the transfer bias consisting of a DC voltage needs to be switched to a superimposed transfer bias.

The intermediate transfer belt 31 having passed the secondary transfer nip has post-transfer residual toner adhering thereto, which has not been transferred to the recording sheet P. The residual toner is cleaned off the surface of the intermediate transfer belt 31 by the belt cleaning device 37 that comes into contact with the outer circumferential surface of the intermediate transfer belt 31. The cleaning backup roller 34 disposed inside the loop of the intermediate transfer belt 31 backs up, from inside the loop, the cleaning of the intermediate transfer belt 31 by the belt cleaning device 37.

Figure 3A:
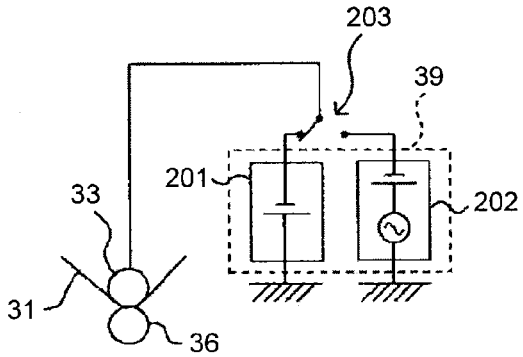
FIGS. 3A and 3B are schematic diagrams illustrating an operation in which a direct current transfer bias and a superimposed transfer bias are switched and applied to a secondary transfer section.
Figure 3B:
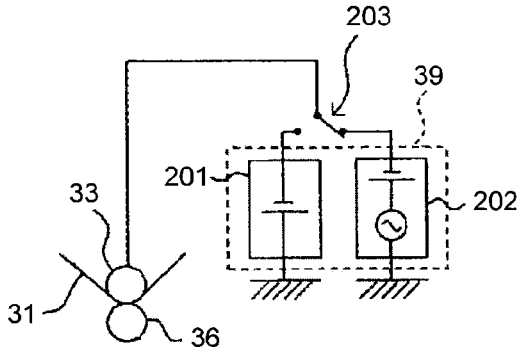

FIGS. 3A and 3B are schematic diagrams illustrating an operation in which the direct current transfer bias and the superimposed transfer bias are switched and applied to a secondary transfer section.

The secondary transfer bias power supply 39 of the embodiment includes a direct current (DC) power supply 201 and an alternating current (AC)/direct current (DC) superimposed power supply 202. In FIG. 3A, a switch 203 is operated to apply the direct current transfer bias from the DC power supply 201, and in FIG. 3B, the switch 203 is operated to apply the superimposed transfer bias from the AC/DC superimposed power supply 202. In this example, the switch 203 is used to conceptually represent the switching between the DC power supply 201 and the AC/DC superimposed power supply 202. However, as described later with reference to FIG. 5, two relays may be used for the switching therebetween in the embodiment of the present invention.

Figure 4:
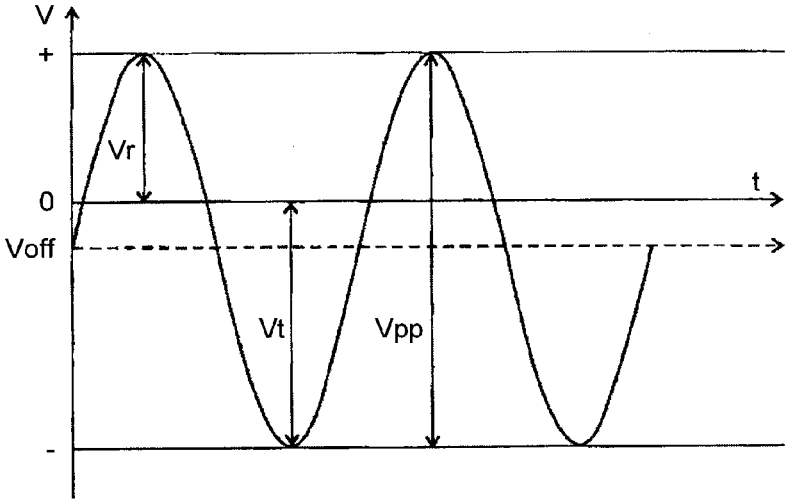
FIG. 4 is a waveform chart illustrating an example of a waveform of a secondary transfer bias including a superimposed transfer bias that is output from a secondary transfer bias power supply in the printer according to the embodiment.

FIG. 4 is a waveform chart illustrating an example of a waveform of the secondary transfer bias consisting of a superimposed transfer bias that is output from the secondary transfer bias power supply.

The secondary transfer bias of the embodiment is applied to the core of the secondary transfer back side roller as described above. When the secondary transfer bias is applied to the core of the secondary transfer back side roller, the electric potential difference (transfer bias) is generated between the core of the secondary transfer back side roller 33 and the core of the nip formation roller 36. In the embodiment, the value of the electric potential difference (transfer bias) is obtained by subtracting the electric potential of the core of the nip formation roller 36 from the electric potential of the core of the secondary transfer back side roller 33. In the structure in which the toner of negative polarity is used as in the embodiment, when the time-averaged value of the electric potential difference is negative, the electric potential of the nip formation roller 36 is made greater than the electric potential of the secondary transfer back side roller 33 in the polarity opposite to the charge polarity of the toner (in positive in the embodiment). Accordingly, the toner is electrostatically moved from the secondary transfer back side roller to the nip formation roller.

With reference to FIG. 4, in the superimposed transfer bias having a sinusoidal waveform as in the embodiment, the offset voltage Voff of the superimposed transfer bias is equal to the voltage of the direct current component of the superimposed transfer bias. The peak-to-peak voltage Vpp of the superimposed transfer bias is equal to the peak-to-peak voltage of the alternating current component of the superimposed transfer bias. Because, in the printer according to the embodiment, as described above, the secondary transfer bias is applied to the core of the secondary transfer back side roller 33 and the core of the nip formation roller 36 is grounded, the electric potential difference between the both cores thus corresponds to the secondary transfer bias applied to the core of the secondary transfer back side roller 33.

If the secondary transfer bias has the same negative polarity as the polarity of the toner, the toner of negative polarity is electrostatically pushed from the secondary transfer back side roller 33 toward the nip formation roller 36 in the secondary transfer nip. Thereby, the toner on the intermediate transfer belt 31 is transferred onto the recording sheet P. If the secondary transfer bias has positive polarity opposite the polarity of the toner, the toner of negative polarity is electrostatically attracted from the nip formation roller 36 toward the secondary transfer back side roller 33 in the secondary transfer nip. Thereby, the toner transferred to the recording sheet P is again attracted toward the intermediate transfer belt 31. However, the time-averaged value of the secondary transfer bias (equal to the value of the offset voltage Voff in this example) is negative polarity, in the secondary transfer nip, the action of pushing off the toner of negative polarity from the secondary transfer back side roller 33 to the nip formation roller 36 is relatively larger. In FIG. 4, a returning potential peak value Vr indicates the peak value of the positive polarity opposite the polarity of the toner, and a transferring potential peak value Vt indicates the peak value of the polarity that is the same as the polarity of the toner.

If images are formed on a recording sheet P with large surface unevenness such as a sheet of Japanese paper or an embossed sheet, the superimposed transfer bias is used as the secondary transfer bias to transfer the toner from the intermediate transfer belt 31 to the recording sheet P while moving the toner back-and-forth, thereby transferring the toner onto the recording sheet. Thereby, transfer rate of toner to recesses in the surface of the sheet is increased, thus an uneven density pattern due to the pattern of the surface unevenness of the sheet can be suppressed. On the other hand, if the recording sheet P with relatively small surface unevenness such as an ordinary transfer paper sheet is used, the direct current transfer bias consisting of the direct current component is used as the secondary transfer bias, whereby sufficient transferability can be obtained.

In this way, the embodiment employs a configuration that includes the direct current transfer mode in which the direct current transfer bias as the secondary transfer bias is applied to transfer an image onto the recording sheet P, and the superimposed transfer mode in which the superimposed transfer bias, i.e., the alternative current is superimposed on the direct current is applied to transfer an image onto the recording sheet P, and enables switching between the two modes. The transfer mode is switched between the direct current transfer mode and the superimposed transfer mode depending on the type of recording sheet P that is fed, thereby making it possible to transfer an image optimally on both a sheet with relatively small surface unevenness and a sheet with relatively large surface unevenness. A configuration may be employed in which the transfer mode is automatically switched in accordance with the type of the recording sheet P. Alternatively, a configuration may be employed that allows a user to specify the transfer mode. A configuration may be employed in which these settings can be performed on the operation panel of the image forming apparatus.

Figure 5:
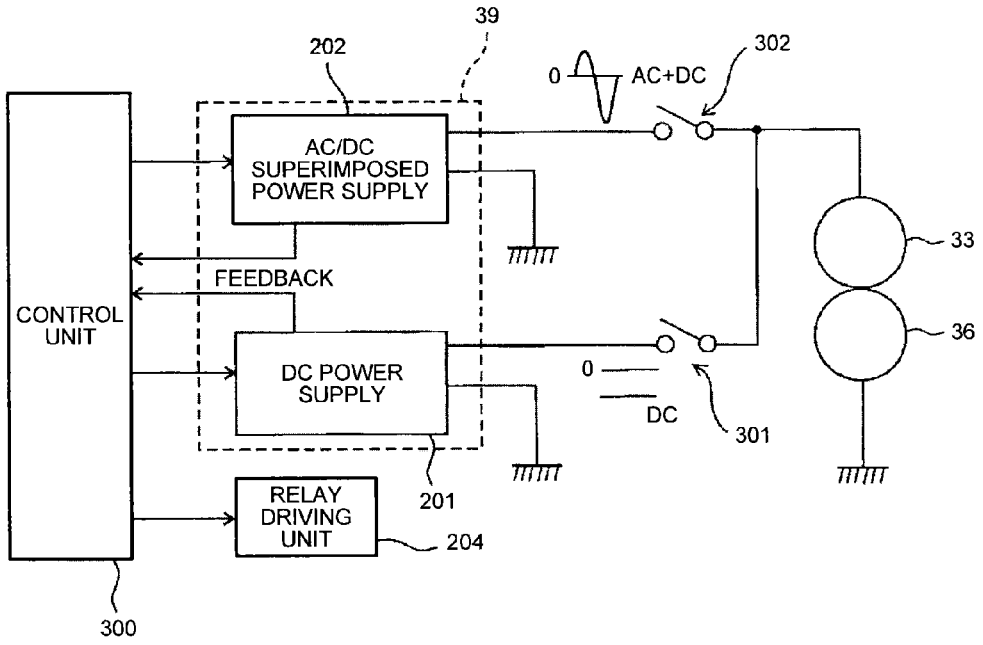
FIG. 5 is a block diagram illustrating an example of a secondary transfer bias applying section.

FIG. 5 is a block diagram illustrating an example of the structure of a secondary transfer bias applying section.

In the example illustrated in FIG. 5, two relays are used to switch the power supplies to apply the bias. As illustrated in FIG. 5, the DC power supply 201 applies the direct current transfer bias through a relay 301 to the secondary transfer back side roller 33. The AC/DC superimposed power supply 202 applies the superimposed transfer bias through a relay 302 to the secondary transfer back side roller 33. The two relays 301 and 302 are controlled by a control unit 300 through a relay driving unit 204 to connect or to shut off, switching between the direct current transfer bias and the superimposed transfer bias as the secondary transfer bias.

Operations of a preliminary refresh mode (preliminary toner forced consumption control) according to the embodiment will now be described.

Figure 6:
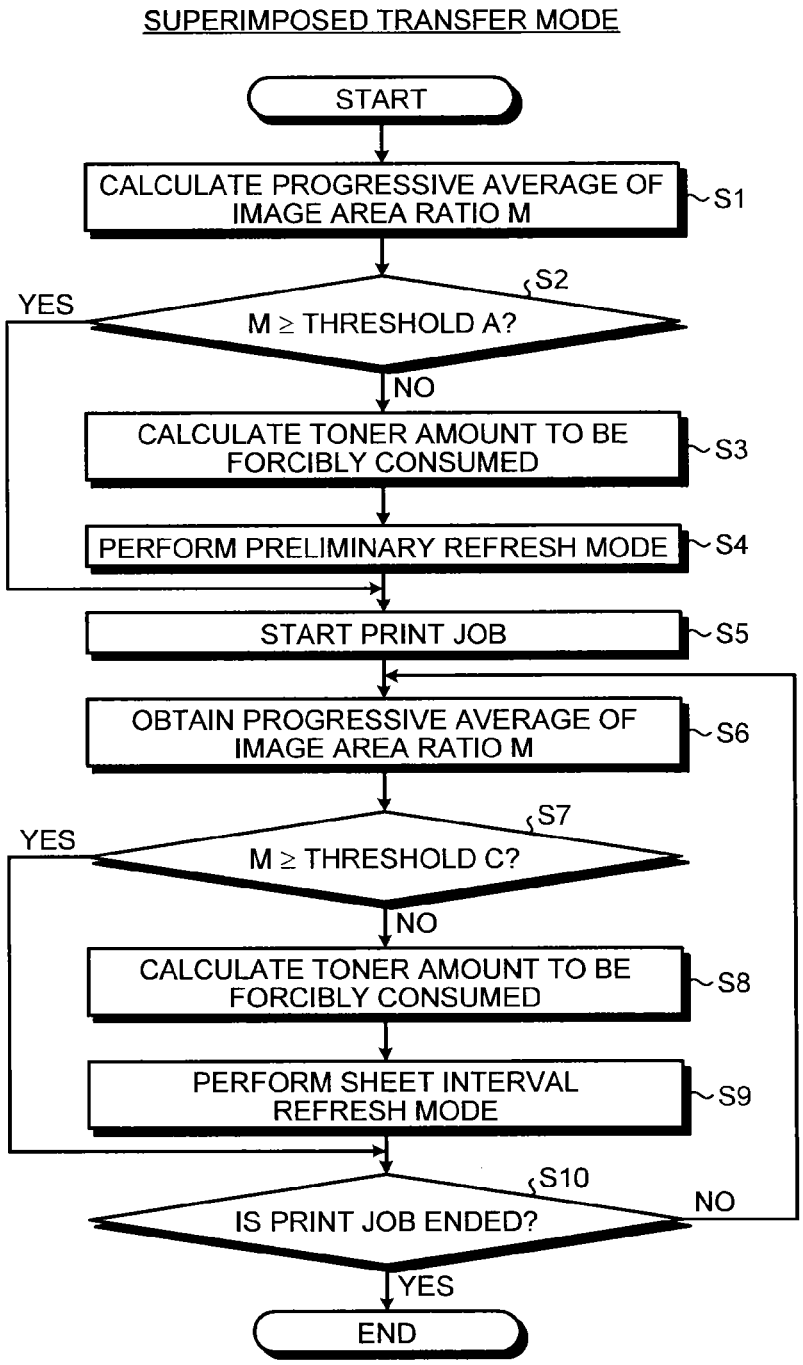
FIG. 6 is a control flowchart of processing of a print job when a superimposed transfer mode is selected.

FIG. 6 is a control flowchart of processing of a print job when the superimposed transfer mode is selected.

The preliminary refresh mode is a control mode, in which when a transfer bias switching condition (specific performance condition) that the superimposed transfer mode is selected is met, toner forced consumption control is performed before an image forming operation in the superimposed transfer mode is started. In the embodiment, even if the direct current transfer mode is selected, as described later (refer to FIG. 7), the preliminary refresh mode is not performed. The content of the preliminary refresh mode is common to all of the image forming units 1Y, 1M, 1C, and 1K, therefore, description only for the image forming unit 1K for the K color will be made below.

In the preliminary refresh mode, a certain electrostatic latent image for a toner consumption pattern is formed on the photosensitive element 2K by the optical writing unit 80, which is then subjected to development processing by the developing unit 8K, whereby the toner in the developing unit 8K is consumed. In the embodiment, the toner consumption pattern (toner image) thus formed on the photosensitive element 2K is primarily transferred to the intermediate transfer belt 31, and then collected by the belt cleaning device 37. At this time, the nip formation roller 36 is separated away from the intermediate transfer belt 31 by a contacting and separating mechanism not illustrated.

In the embodiment, when the superimposed transfer mode is selected, the preliminary refresh mode is not always performed. Whether to perform it is determined based on the progressive average of the area ratio of the images formed during a certain period in the past. Specifically, the control unit 300 obtains pixel information when the optical writing unit 80 writes the electrostatic latent image onto the photosensitive element 2K. From the pixel information, the image area ratio of the images formed during a certain period in the past (based on the driving time of the developing unit 8K) is calculated. The calculated image area ratio is stored sequentially in a storage device not illustrated (the image area ratio storage unit). Then, from the calculated image area ratio for a plurality of periods, the progressive average of the image area ratio is calculated (S1). If the calculated progressive average of the image area ratio is lower than a predetermined threshold A (No at S2), the preliminary refresh mode is performed (S3 and S4). If the calculated progressive average of the image area ratio is equal to or larger than the predetermined threshold A (Yes at S2), the preliminary refresh mode is not performed.

The toner amount to be forcibly consumed during the preliminary refresh mode may be constant, however, in the embodiment, the toner amount is determined based on the above-described progressive average of the image area ratio (S3). Specifically, the smaller the progressive average of the image area ratio is (the larger the difference from the above-described threshold A is), the larger an amount of consumed toner is.

Whether to perform the preliminary refresh mode is determined for each of the image forming units 1Y, 1M, 1C, and 1K. If the condition to perform the preliminary refresh mode is met for any one of the image forming units, the preliminary refresh mode is performed for all the image forming units 1Y, 1M, 1C, and 1K. At this time, the toner amount to be forcibly consumed in each of the image forming units 1Y, 1M, 1C, and 1K is determined depending on the progressive average of the image area ratio of each of the image forming units 1Y, 1M, 1C, and 1K, and thus the toner amount varies depending on the image forming units. If the condition to perform the preliminary refresh mode is met for any one of the image forming units, the preliminary refresh mode may be performed only for that image forming unit.

Figure 7:
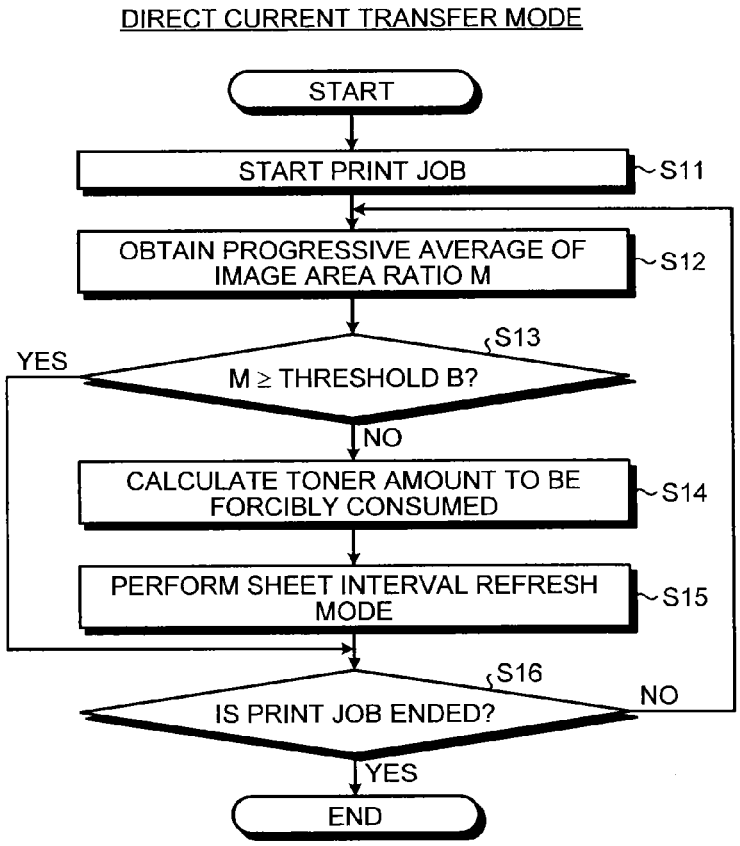
FIG. 7 is a control flowchart of processing of a print job when a direct current transfer mode is selected.

Once the preliminary refresh mode is performed as described above, a print job is started in the superimposed transfer mode (S5). In the embodiment, the toner forced consumption control is performed also in a print job as necessary. This control corresponds to a control mode in which the toner forced consumption control is performed during a non-development process period (a period corresponding to an interval between sheets) in the intervals of a development process period for each image while consecutive image forming is in operation (during the print job) in which image forming is consecutively performed on the recording sheets P. Hereinafter, the control mode is referred to as a sheet interval refresh mode (image interval toner forced consumption control). In the embodiment, as illustrated in FIG. 7, if a certain condition to perform the toner forced consumption control is met after a print operation in the direct current transfer mode is started (S11), the sheet interval refresh mode is performed even while consecutive image forming is in operation in the direct current transfer mode.

In the sheet interval refresh mode, a certain electrostatic latent image for a toner consumption pattern is formed on the photosensitive element 2K by the optical writing unit 80, which is then subjected to development processing by the developing unit 8K together with the electrostatic latent images depending on the image information existing before and after the formation of the certain electrostatic latent image, whereby the toner in the developing unit 8K is forcibly consumed. The toner consumption pattern (toner image) thus formed on the photosensitive element 2K is primarily transferred to the intermediate transfer belt 31, and then collected by the belt cleaning device 37. At this time, immediately before the leading end of the toner consumption pattern on the intermediate transfer belt 31 enters the secondary transfer nip, the nip formation roller 36 is separated away from the intermediate transfer belt 31 by the contacting and separating mechanism. And immediately after the trailing end of the toner consumption pattern on the intermediate transfer belt 31 passes through the secondary transfer nip, the nip formation roller 36 is brought into contact with the intermediate transfer belt 31 by the contacting and separating mechanism.

In the embodiment, whether to perform the sheet interval refresh mode is determined based on the progressive average of the image area ratio of the images formed during the latest periods, every time an image is formed while consecutive image forming is in operation. Specifically, likewise in the preliminary refresh mode, the progressive average of the image area ratio is calculated (S6 and S12) until the end of a print job (S10 and S16). If the progressive average of the image area ratio is lower than a predetermined threshold (No at S7, No at S13), the sheet interval refresh mode is performed during a period corresponding to the next interval between sheets (S8, S9, S14, and S15). In the embodiment, the predetermined threshold in the direct current transfer mode is different from the predetermined threshold in the superimposed transfer mode. A threshold B used in the direct current transfer mode is set so as to be smaller than a threshold C used in the superimposed transfer mode.

The toner amount to be forcibly consumed during the sheet interval refresh mode is set so that the progressive average of the image area ratio that is inversely calculated from the total of the toner consumption amount due to image information and the toner consumption amount to be forcibly consumed during the refresh mode becomes equal to the above-described threshold B if it is in the direct current transfer mode, and becomes equal to the above-described threshold C if it is in the above-described threshold B (S8 and S14). However, a period corresponding to an interval between sheets is remarkably short, and thus the toner amount that can be consumed during the period is limited. Accordingly, there is a case that a target amount of toner cannot be forcibly consumed in one sheet interval refresh mode. In this case, the toner amount that has not been able to be consumed will be forcibly consumed in a sheet interval refresh mode during a period corresponding to the next or later interval between sheets.

As an example of the above-described thresholds, the threshold A and the threshold C are set to 5% and the threshold B is set to 3%. As for the toner consumption pattern, an image having an image area ratio of 56% can be used. The toner consumption patterns are formed in a superimposing manner using two colors Y and C, or M and K in the example described above, however, it is not limited to this example. The image area ratio is calculated at every predetermined time (during when the developing unit is driven), but the image area ratio may be calculated every time a sheet is printed.

Modification 1

An example of the superimposed transfer bias according to the embodiment (hereinafter, the modification is referred to as Modification 1) will now be described.

Figure 8A:
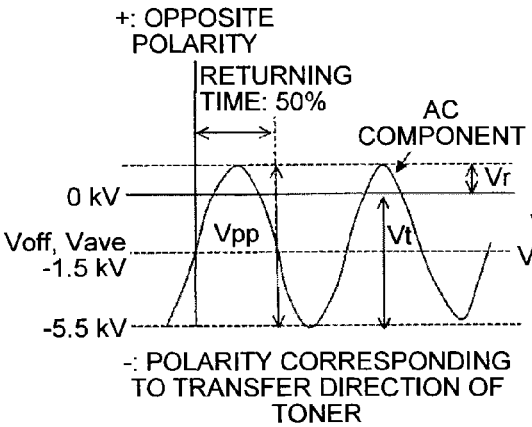
FIG. 8A is a graph illustrating the superimposed transfer bias used in the embodiment.
Figure 8B:
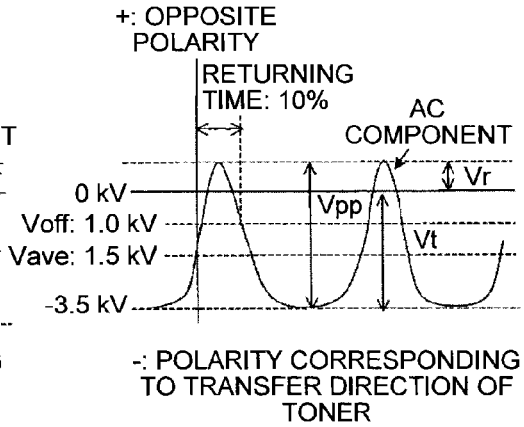
FIG. 8B is a graph illustrating the superimposed transfer bias used in Modification 1.

FIG. 8A is a graph illustrating the superimposed transfer bias used in the above-described embodiment, and FIG. 8B is a graph illustrating a superimposed transfer bias used in Modification 1.

In the above-described embodiment, as illustrated in FIG. 8A, the time-averaged value of the superimposed transfer bias (Vave) corresponds to the offset voltage Voff. By contrast, as illustrated in FIG. 8B, the superimposed transfer bias in Modification 1 is set such that the time-averaged value (Vave) of the superimposed transfer bias is shifted to the transfer direction than the offset voltage Voff.

In Modification 1, the percentage of the time in which a bias value shifted to the polarity opposite the transfer direction than the offset voltage Voff is applied (returning time) is set to 10% of one period of the superimposed transfer bias. The preferred percentage of the returning time is equal to or larger than 4% to equal to or smaller than 45%. As illustrated in FIG. 8A, the percentage of the returning time in the above-described embodiment is 50%.

According to Modification 1, the transfer rate of toner to recesses in the surface of the sheet when an image is formed on the recording sheet P with relatively large surface unevenness is higher compared with an example in which the ratio of the returning time is 50% as in the above-described embodiment, whereby occurrence of an uneven density pattern can be further suppressed.

Figures 9, 10:
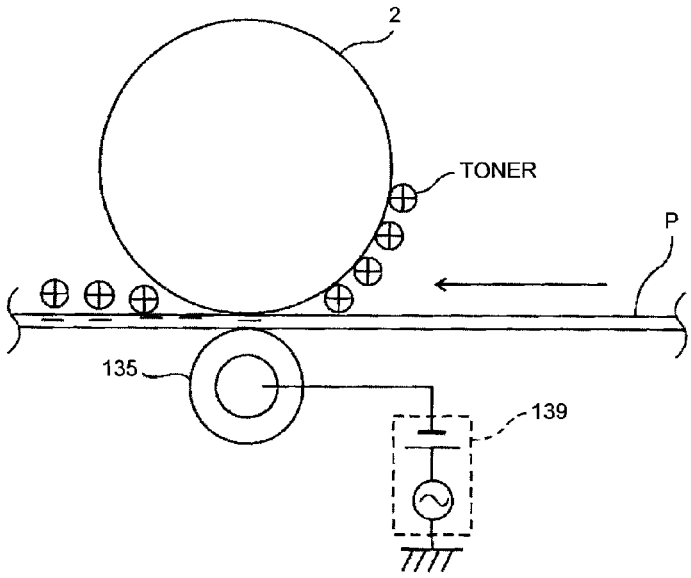
FIG. 9 is a table representing the results of effect confirmation tests.
FIG. 10 is a schematic structural diagram illustrating an example of a one-drum type image forming apparatus with a direct transfer system.

FIG. 9 is a table representing the results of effect confirmation tests by the present inventors.

In the effect confirmation tests, 5000 sheets of blank plain paper was fed through the printer in advance to make the toner in the developing unit of the printer deteriorated. Then a test image was consecutively formed on a recording sheet with relatively large surface unevenness and the level of transferability of the image was evaluated. The level of transferability was evaluated by visual inspection with a five-stage rating. Rating 5 represents the best and 1 the worst. The permissible level is rating 4.

Other test conditions were as follows.

Humidity and temperature: 23° C., 50%

Sheet of paper to be fed: T6000 <70W> A4

Image on the sheet: blank (Y: 0%, C: 0%, M: 0%, K: 0%)

Test sheet: Rezak 66 A4 (ream rate: 130 kg)

Test image: solid blue on the whole surface of the sheet (Y: 0%, C: 100%, M: 100%, K: 0%)

Evaluation item: transferability (white dots or lines in recesses)

As illustrated in FIG. 9, when the direct current transfer mode was selected and neither the preliminary refresh mode nor the sheet interval refresh mode was performed (test A), the evaluation of the level of transferability was rating 2 in the beginning of image forming of the test image, when 2000 sheets had passed through the printer from the beginning of image forming of the test image, and when 5000 sheets had passed through the printer from the beginning of image forming of the test image.

As illustrated in FIG. 9, when the superimposed transfer mode (the percentage of the returning time was 50%) was selected and neither the preliminary refresh mode nor the sheet interval refresh mode was performed (test B), and even though there was improvement with regard to rating 2 in the direct current transfer mode, the evaluation of the level of transferability was only rating 3 for all of the evaluation times.

As illustrated in FIG. 9, when the superimposed transfer mode (the percentage of the returning time was 50%) was selected and the preliminary refresh mode was performed but the sheet interval refresh mode was not performed (test C), for a certain time from the beginning of image forming of the test image, the permissible rating 4 was obtained as a result of forcibly consuming the deteriorated toner in the preliminary refresh mode. However, as the image forming of the test image was continued, the deteriorated toner in the developing unit gradually increased and the rating was lowered to 3.5 when 2000 sheets had passed through the printer from the beginning of image forming of the test image, and the rating was further lowered to 3 when 5000 sheets had passed through the printer from the beginning of image forming of the test image.

As illustrated in FIG. 9, when the superimposed transfer mode (the percentage of the returning time was 50%) was selected and both the preliminary refresh mode and the sheet interval refresh mode were performed (test D), the evaluation of the level of transferability was as high as rating 4 for all of the evaluation times.

As illustrated in FIG. 9, when the superimposed transfer mode (the percentage of the returning time was 10%) was selected and both the preliminary refresh mode and the sheet interval refresh mode were performed (test E), the evaluation of the level of transferability was still higher at a rating of 4.5 for all of the evaluation times.

In the descriptions above, a tandem type image forming apparatus with an intermediate transfer system that transfers the toner images on the photosensitive elements 2Y, 2M, 2C, and 2K onto the recording sheet P via the intermediate transfer belt 31 has been exemplified. However, as illustrated in FIG. 10, a one-drum type image forming apparatus with a direct transfer system that directly transfers the toner images formed on a single photosensitive element 2 onto the recording sheet P can also be used. In the example in FIG. 10, the transfer bias power supply 139 including the DC power supply and the AC power supply is coupled to the core of a transfer roller 135 that forms the transfer nip with the photosensitive element 2 to selectively apply the direct current transfer bias or the superimposed transfer bias to the transfer nip. In the structure illustrated in FIG. 10, a normal charge polarity of the toner is positive. The core of the transfer roller 135 may have a foamed layer or a surface coated layer thereon.

Figure 11:
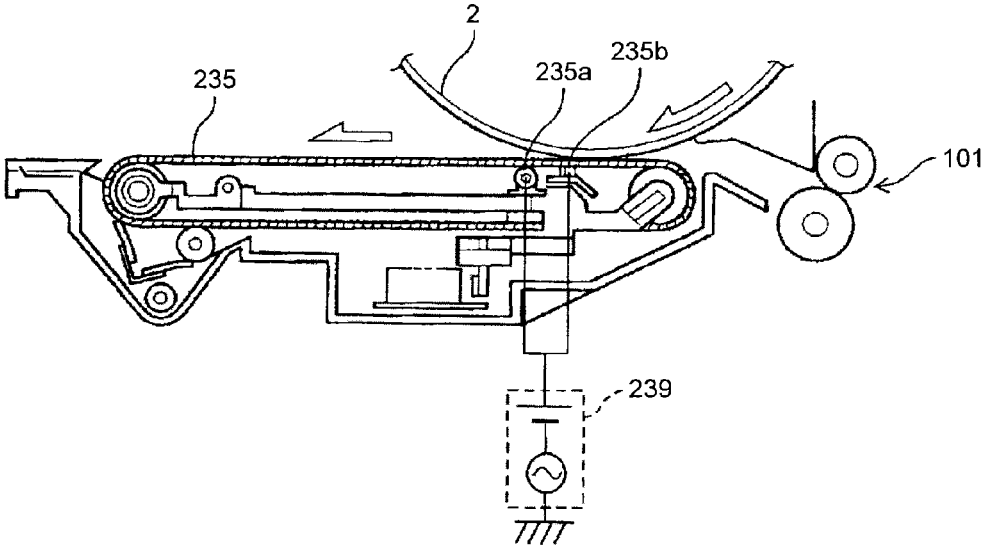
FIG. 11 is a schematic structural diagram illustrating an example of a one-drum type image forming apparatus with a direct transfer system using a transfer belt as a transfer member.

As an example of an image forming apparatus with a direct transfer system, as illustrated in FIG. 11, the transfer nip may be formed between the photosensitive element 2 and a transfer belt 235. In the structure illustrated in FIG. 11, the transfer belt 235 is bridged over two supporting rollers, and a bias roller 235*a* and a bias brush 235*b* come in contact with or in the proximity of the inner circumferential surface of a part of the transfer belt where the transfer nip is formed. The transfer bias power supply 239 including the DC power supply and the AC power supply is coupled to the bias roller 235*a* and the bias brush 235*b* to selectively apply the direct current transfer bias or the superimposed transfer bias to the transfer nips. It should be noted that, in the structure illustrated in FIG. 11, a normal charge polarity of the toner is negative.

In the structure illustrated in FIG. 11, the two members, the bias roller 235*a* and the bias brush 235*b* are used as a bias applying member. However, the two members may be both roller members, or both brush members. The bias applying member may include only one member. In addition, the bias applying member may be a non-contact charger. In the structure illustrated in FIG. 11, the bias applying member is disposed on a position slightly shifted to the downstream side in the recording sheet conveying direction from the inner circumferential surface of a part of the transfer belt where the transfer nip is formed. However, the bias applying member may be disposed on the inner circumferential surface of a part of the transfer belt where the transfer nip is formed.

Figure 12:
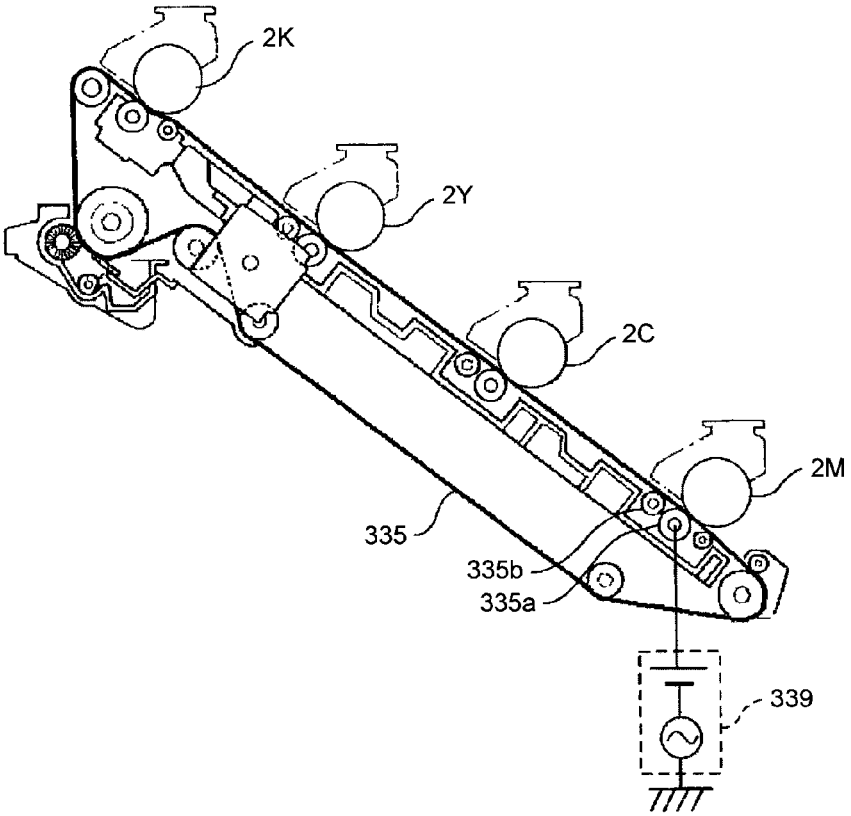
FIG. 12 is a schematic structural diagram illustrating an example of a tandem type image forming apparatus with a direct transfer system.
Figure 13:
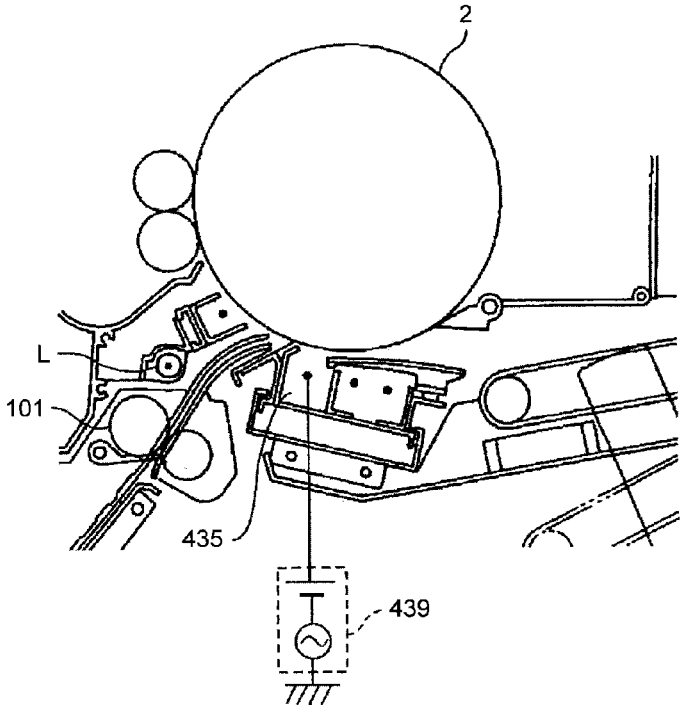
FIG. 13 is a schematic structural diagram illustrating an example of a one-drum type image forming apparatus with a direct transfer system using transfer charger as a transfer member.

The image forming apparatus with a direct transfer system may be a tandem type image forming apparatus with a direct transfer system in which the toner images formed on the four photosensitive elements 2Y, 2M, and 2C are directly transferred onto the recording sheet P in a superimposing manner as illustrated in FIG. 12. In the structure illustrated in FIG. 12, the transfer nips are formed between the four photosensitive elements 2Y, 2M, 2C, and 2K and a transfer belt 335 respectively and a bias roller 335*a* and a backup roller 335*b* come in contact with or in the proximity of the inner circumferential surface of a part of the transfer belt where the respective transfer nips are formed. A transfer bias power supply 339 including the DC power supply and the AC power supply is coupled to the respective bias rollers 335*a* to selectively apply the direct current transfer bias or the superimposed transfer bias to the respective transfer nips. In FIG. 12, only the transfer bias power supply 339 corresponding to the transfer nip of the photosensitive element 2M for the M color is illustrated and other transfer bias power supplies corresponding to the transfer nips of the photosensitive elements are omitted. It should be noted that, in the structure illustrated in FIG. 12, a normal charge polarity of the toner is negative.

Figure 14:
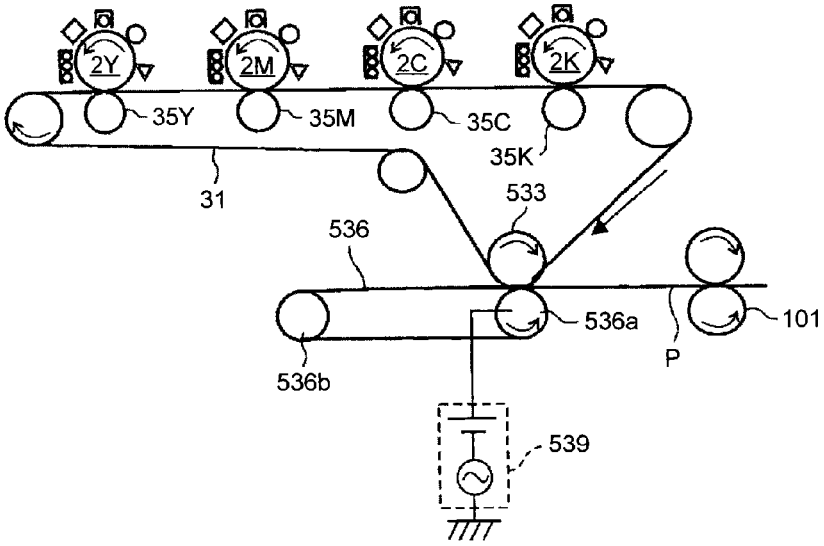
FIG. 14 is a schematic structural diagram illustrating an example of a tandem type image forming apparatus with an intermediate transfer system using a sheet conveying belt as a secondary transfer member.

As an example of an image forming apparatus with an intermediate transfer system, as illustrated in FIG. 14, a sheet conveying belt 536 may be used as a secondary transfer member. In the structure illustrated in FIG. 14, the sheet conveying belt 536 is bridged over two supporting rollers 536*a* and 536*b*. A transfer bias power supply 539 including the DC power supply and the AC power supply is coupled to the supporting roller 536*a* that comes in contact with the inner circumferential surface of a part of the sheet conveying belt where the secondary transfer nip is formed with the intermediate transfer belt 31. With this structure, the direct current transfer bias or the superimposed transfer bias is selectively applied to the secondary transfer nip. However, in the same manner as the above-described embodiment, the transfer bias power supply may be coupled to a secondary transfer back side roller 533 that comes in contact with the inner circumferential surface of a part of the sheet conveying belt where the secondary transfer nip is formed to selectively apply the direct current transfer bias or the superimposed transfer bias to the secondary transfer nip.

The embodiments have been described by way of example only, and the present invention has specific advantageous effects for each of the following aspects.

Aspect A

An image forming apparatus includes a latent image carrier (e.g., the photosensitive element 2) that carries on its surface a latent image depending on image information, a developing unit 8 that performs development processing in which toner is caused to adhere to the latent image on the latent image carrier by a developer so as to form a toner image, a transfer unit (e.g., the transfer unit 30) that transfers the toner image formed on the latent image carrier through the development processing onto a recording medium (e.g., the recording sheet P) directly or via an intermediate transfer member (e.g., the intermediate transfer belt 31), a transfer bias switching unit (e.g., the control unit 300) that switches a transfer bias applied by the transfer unit when a toner image is transferred on the recording medium, between a direct current transfer bias consisting of a direct current component and a superimposed transfer bias in which an alternating current component is superimposed on a direct current component and the polarity of the superimposed transfer bias changes with time, according to a certain transfer bias switching condition, and a toner forced consumption control unit that performs toner forced consumption control (e.g., the control unit 300) in which toner in the developing unit is forcibly consumed when a certain condition to perform the toner forced consumption control is met. The certain condition to perform the toner forced consumption control includes a specific performance condition that a transfer bias switching condition to switch the transfer bias to the superimposed transfer bias is met. When the specific performance condition is met, the toner forced consumption control unit performs preliminary toner forced consumption control in which the toner forced consumption control (e.g., the preliminary refresh mode) is performed before an image forming operation using the superimposed transfer bias (the print job in the superimposed transfer mode) is started.

According to this, the preliminary toner forced consumption control is performed before an image forming operation using the superimposed transfer bias is started so that the toner in the developing unit is forcibly consumed, whereby the amount of deteriorated toner in the developing unit can be reduced. As a result, during a consecutive image forming operation using the superimposed transfer bias, the toner image with little amount of deteriorated toner can be formed. Therefore, the effect of the deterioration of toner on the transferability when the toner image is transferred to the recording medium can be reduced. Specifically, as described above, even if image forming is performed on the recording medium with relatively large surface unevenness using the superimposed transfer bias in such a state deterioration of toner in a developing unit of the image forming apparatus has progressed, appropriate transferability can be obtained, thereby making it possible to form a high-quality image in which an uneven density pattern due to the pattern of unevenness on the surface of the sheet is suppressed.

According to Aspect A, however, there is a demerit in that a time to start the image forming operation using the superimposed transfer bias delays or a downtime occurs because the preliminary toner forced consumption control described above is performed. In this respect, generally, the superimposed transfer bias is used when image forming is performed on a specific recording medium with unevenness on its surface as described above. In such a case, image quality tends to be more important than processing speed. Therefore, the aspect according to the present invention capable of improving transferability is still useful in spite of the demerit.

Aspect B

The image forming apparatus according to Aspect A also includes an image area ratio storage unit that stores therein the image area ratio of an image formed during a certain period in the past. When the specific performance condition is met, the toner forced consumption control unit determines whether to perform the preliminary toner forced consumption control depending on the image area ratio (the progressive average of the image area ratio) stored in the image area ratio storage unit, and if the toner forced consumption control unit determines that the preliminary toner forced consumption control is not to be performed, the preliminary toner forced consumption control is not performed.

If the image area ratio of the image formed during a certain period in the past is low, deterioration of toner in the developing unit of the image forming apparatus has progressed, thus the preliminary toner forced consumption control needs to be performed before an image forming operation using the superimposed transfer bias is started. By contrast, if the image area ratio of the image formed during the certain period in the past is high, little amount of deteriorated toner remains in the developing unit, thus the effect of the deterioration of toner on the transferability is small. According to Aspect B, because the preliminary toner forced consumption control is not performed in a state that the effect of the deterioration of toner on the transferability is small, a time delay in starting an image forming operation or an occurrence of a downtime due to an unnecessary preliminary toner forced consumption control can be suppressed.

Aspect C

The image forming apparatus according to Aspect A or B includes the image area ratio storage unit that stores therein the image area ratio of an image formed during a certain period in the past, and when the specific performance condition is met, the toner forced consumption control unit determines a toner amount to be forcibly consumed in the preliminary toner forced consumption control depending on the image area ratio stored in the image area ratio storage unit, and the preliminary toner forced consumption control is performed so that the thus determined toner amount is forcibly consumed.

If the image area ratio of the image formed during a certain period in the past is low, a large amount of deteriorated toner remains in the developing unit. On the other hand, if the image area ratio is high, there is a little amount of deteriorated toner in the developing unit. In this respect, if the toner amount to be forcibly consumed under the preliminary toner forced consumption control is constant, the toner amount to be forcibly consumed becomes insufficient in light of the amount of the deteriorated toner in the developing unit, whereby the transferability when image forming is performed using the superimposed transfer bias cannot be appropriately obtained. On the other hand, if the toner amount to be forcibly consumed becomes excessive in light of the amount of the deteriorated toner in the developing unit, toner is wasted. According to Aspect C, an appropriate amount of toner depending on the amount of the deteriorated toner remaining in the developing unit can be forcibly consumed, whereby the problem described above is mitigated.

Aspect D

In the image forming apparatus according to any one of Aspect A to C, when another condition to perform the toner forced consumption control different from the specific performance condition is met, the toner forced consumption control unit performs image interval toner forced consumption control (e.g., sheet interval refresh mode) in which the toner forced consumption control is performed during a non-development process period in the intervals of and outside a development process period during which a latent image depending on the image information is developed for each image while consecutive image forming is in operation.

According to Aspect D, even if deterioration of toner in the developing unit has progressed during a consecutive image forming operation, deterioration of image quality due to the deteriorated toner can be suppressed without a downtime.

Aspect E

In the image forming apparatus according to Aspect D, the toner forced consumption control unit controls the toner amount to be forcibly consumed in the image interval toner forced consumption control so that a larger amount of toner is consumed during a consecutive image forming operation using the superimposed transfer bias, than during a consecutive image forming operation using the direct current transfer bias.

Deterioration of image quality due to the deteriorated toner occurs not only when image forming is performed on a recording medium with relatively large surface unevenness using the superimposed transfer bias, but also when image forming is performed on a recording medium with relatively small surface unevenness using the direct current transfer bias. However, the former has a more severe effect of the deterioration of toner on the deterioration of image quality than the latter. According to Aspect E, during a consecutive image forming operation using the direct current transfer bias, in which the effect of the deterioration of toner on the deterioration of image quality is small, the toner amount to be forcibly consumed in the image interval toner forced consumption control is reduced, whereby wasting toner is suppressed. On the other hand, during a consecutive image forming operation using the superimposed transfer bias, in which the effect of the deterioration of toner on the deterioration of image quality is large, the toner amount to be forcibly consumed in the image interval toner forced consumption control is increased, whereby appropriate image quality can be maintained.

Aspect F

In the image forming apparatus according to any one of Aspect A to E, the superimposed transfer bias is set such that the time-averaged value (Vave) of the superimposed transfer bias has polarity corresponding to a transfer direction in which the toner image is transferred from the latent image carrier or the intermediate transfer member to the recording medium, and is shifted to the transfer direction than the center value (Voff) of the maximum value and the minimum value of the superimposed transfer bias.

According to Aspect F, more appropriate transferability can be obtained when image forming is performed on a recording medium with relatively large surface unevenness compared with an example in which the superimposed transfer bias having the time-averaged value Vave equal to the value of the offset voltage Voff is used.

The embodiment can provide the advantageous effect of improving transferability when a superimposed transfer bias is used even if deterioration of toner in a developing unit of an image forming apparatus has progressed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a latent image carrier that carries on a surface thereof a latent image depending on image information;

a developing unit that performs development processing in which toner is caused to adhere to the latent image on the latent image carrier by a developer so as to form a toner image;

a transfer unit that transfers the toner image formed on the latent image carrier through the development processing, onto a recording medium directly or via an intermediate transfer member;

a transfer bias switching unit that switches a transfer bias applied to the transfer unit when the toner image is transferred on the recording medium, between a direct current transfer bias consisting of a direct current component and a superimposed transfer bias in which an alternating current component is superimposed on a direct current component and polarity of the superimposed transfer bias changes with time, according to a certain transfer bias switching condition; and a toner forced consumption control unit that performs toner forced consumption control in which toner in the developing unit is forcibly consumed in response to a certain condition to perform the toner forced consumption control being met;

wherein the certain condition includes a specific performance condition that a transfer bias switching condition to switch the transfer bias to the superimposed transfer bias is met, and wherein in response to at least the specific performance condition being met, the toner forced consumption control unit performs preliminary toner forced consumption control in which the toner forced consumption control is performed before image forming operations are started for a print job using the superimposed transfer bias.

2. The image forming apparatus according to claim 1, further comprising an image area ratio storage unit that stores therein image area ratio of an image formed during a certain past period, wherein the specific performance condition is met and the toner forced consumption control unit determines whether the certain condition is met depending on the image area ratio stored in the image area ratio storage unit, and wherein the toner forced consumption control unit determines that the certain condition is not met based on the image area ratio and the preliminary toner forced consumption control is not performed.

3. The image forming apparatus according to claim 1, further comprising an image area ratio storage unit that stores therein image area ratio of an image formed during a certain past period, wherein the specific performance condition is met and the toner forced consumption control unit determines a toner amount to be forcibly consumed in the preliminary toner forced consumption control depending on the image area ratio stored in the image area ratio storage unit, and the preliminary toner forced consumption control is performed so that an amount of toner equal to the toner amount is forcibly consumed.

4. The image forming apparatus according to claim 1, wherein a second condition including a different specific performance condition is met, and the toner forced consumption control unit performs image interval toner forced consumption control in which the toner forced consumption control is performed during a non-development process period in intervals of and outside a development process period during which a latent image depending on image information is developed for each image while consecutive image forming is in operation.

5. The image forming apparatus according to claim 4, wherein the toner forced consumption control unit controls a toner amount to be forcibly consumed in the image interval toner forced consumption control so that a larger amount of toner is consumed during a consecutive image forming operation using the superimposed transfer bias, than during a consecutive image forming operation using the direct current transfer bias.

6. The image forming apparatus according to claim 1, wherein the superimposed transfer bias is set such that the time-averaged value of the superimposed transfer bias has polarity corresponding to a polarity of a transfer direction in which the toner image is transferred from the latent image carrier or the intermediate transfer member to the recording medium, and wherein the polarity of the time-averaged value of the superimposed transfer bias is shifted toward the polarity of the transfer direction more than a center value of a maximum value and a minimum value of the superimposed transfer bias.

7. The image forming apparatus according to claim 1, wherein the transfer unit comprises a transfer roller and a nip formation roller, wherein the transfer roller and the nip formation roller contact the intermediate transfer member to transfer the toner image onto the recording medium, and wherein, the toner forced consumption control unit performs toner forced consumption control, and the nip formation roller is moved by the transfer unit to a position so the nip formation roller does not contact the intermediate transfer member.

8. An image forming apparatus comprising:

a latent image carrier that carries on a surface thereof a latent image depending on image information;

a developing unit that performs development processing in which toner is caused to adhere to the latent image on the latent image carrier by a developer so as to form a toner image;

a transfer unit that transfers the toner image formed on the latent image carrier through the development processing, onto a recording medium directly or via an intermediate transfer member;

a transfer bias switching unit that switches a transfer bias applied to the transfer unit when the toner image is transferred on the recording medium, between a direct current transfer bias consisting of a direct current component and a superimposed transfer bias in which an alternating current component is superimposed on a direct current component and polarity of the superimposed transfer bias changes with time, according to a certain transfer bias switching condition; and a toner forced consumption control unit that performs toner forced consumption control in which toner in the developing unit is forcibly consumed when a first condition to perform the toner forced consumption control is met, wherein the first condition to perform the toner forced consumption control includes a specific performance condition that a transfer bias switching condition to switch the transfer bias to the superimposed transfer bias is met, wherein the specific performance condition is met and the toner forced consumption control unit performs preliminary toner forced consumption control in which the toner forced consumption control is performed before an image forming operation using the superimposed transfer bias is started, wherein a second condition to perform the toner forced consumption control different from the specific performance condition is met and the toner forced consumption control unit performs image interval toner forced consumption control in which the toner forced consumption control is performed during a non-development process period in intervals of and outside a development process period during which a latent image depending on image information is developed for each image while consecutive image forming is in operation, wherein the toner forced consumption control unit controls a toner amount to be forcibly consumed in the image interval toner forced consumption control so that a larger amount of toner is consumed during a consecutive image forming operation using the superimposed transfer bias, than during a consecutive image forming operation using the direct current transfer bias.

* * * * *